US011120730B2

(12) United States Patent
Yang

(10) Patent No.: US 11,120,730 B2
(45) Date of Patent: Sep. 14, 2021

(54) COMPENSATION CIRCUIT FOR DISPLAY IMAGES AND METHOD FOR DETERMINING COMPENSATION REGION OF DISPLAY IMAGES

(71) Applicant: SITRONIX TECHNOLOGY CORP., Jhubei (TW)

(72) Inventor: Ming-Che Yang, Jhubei (TW)

(73) Assignee: Sitronix Technology Corp., Jhubei (TW)

( * ) Notice: Subject to any disclaimer, the term of this patent is extended or adjusted under 35 U.S.C. 154(b) by 0 days.

(21) Appl. No.: 16/220,448

(22) Filed: Dec. 14, 2018

(65) Prior Publication Data

US 2019/0325809 A1 Oct. 24, 2019

Related U.S. Application Data

(60) Provisional application No. 62/598,611, filed on Dec. 14, 2017.

(51) Int. Cl.
*G09G 3/20* (2006.01)

(52) U.S. Cl.
CPC ... *G09G 3/2092* (2013.01); *G09G 2310/0232* (2013.01); *G09G 2320/0233* (2013.01)

(58) Field of Classification Search
None
See application file for complete search history.

(56) References Cited

U.S. PATENT DOCUMENTS 6,894,701 B2 * 5/2005 Brown ..... G06T 11/203 345/613
8,477,250 B2 * 7/2013 Schellingerhout ..... G09F 9/301 345/55
9,754,522 B2 * 9/2017 Park ..... G09G 3/20
2003/0214513 A1 * 11/2003 Brown ..... G06T 11/203 345/611
2010/0019993 A1 * 1/2010 Chui ..... G09F 9/33 345/31
2013/0321369 A1 * 12/2013 Mirski-Fitton ..... G09G 3/3208 345/207
2015/0091953 A1 * 4/2015 Wu ..... G09G 3/2007 345/690

(Continued)

FOREIGN PATENT DOCUMENTS

CN 107103893 A 8/2017
CN 107170364 A 9/2017

(Continued)

*Primary Examiner* — Ryan M Gray
(74) *Attorney, Agent, or Firm* — Rosenberg, Klein & Lee

(57) ABSTRACT

The present invention provides a compensation circuit for display images and a method for determining compensation region for display images. The method calculates a first compensation boundary and a second compensation boundary corresponding to the locations of panel cut regions. The region between the first compensation boundary and the second compensation boundary is an image compensation region for compensating the pixels therein. Thereby, according to the compensation circuit and method of the present invention, the image compensation region can be determined corresponding to the locations of the panel cut regions. By adjusting the compensation boundaries, the image compensation region can be modified.

17 Claims, 6 Drawing Sheets

(56) References Cited

U.S. PATENT DOCUMENTS

| | | | | |
|---|---|---|---|---|
| 2016/0189601 | A1* | 6/2016 | Jung | G09G 3/20 345/212 |
| 2018/0012566 | A1* | 1/2018 | Lin | G09G 5/10 |
| 2018/0017728 | A1* | 1/2018 | Edamitsu | G02B 6/0021 |
| 2018/0114474 | A1* | 4/2018 | Powell | G09G 3/02 |
| 2018/0158417 | A1* | 6/2018 | Xiang | G09G 3/3233 |
| 2018/0166018 | A1* | 6/2018 | Yang | H01L 27/32 |
| 2018/0190190 | A1* | 7/2018 | Xi | G09G 3/3225 |
| 2019/0027112 | A1* | 1/2019 | Hsu | G09G 3/2044 |
| 2019/0043418 | A1* | 2/2019 | Rieutort-Louis | H01L 27/3276 |
| 2019/0051718 | A1* | 2/2019 | Zhang | H01L 27/3276 |
| 2019/0073962 | A1* | 3/2019 | Aflatooni | G09G 3/3275 |
| 2019/0080648 | A1* | 3/2019 | Hwang | G09G 3/3233 |
| 2019/0088188 | A1* | 3/2019 | Zheng | G09G 3/2074 |
| 2019/0139470 | A1* | 5/2019 | Yoo | H04N 13/344 |
| 2019/0246474 | A1* | 8/2019 | Homer | G01J 3/506 |

FOREIGN PATENT DOCUMENTS

| | | | |
|---|---|---|---|
| CN | 107393490 | A | 11/2017 |
| JP | 2011242665 | A | 12/2011 |
| TW | I251202 | B | 3/2006 |

* cited by examiner

COMPENSATION CIRCUIT FOR DISPLAY IMAGES AND METHOD FOR DETERMINING COMPENSATION REGION OF DISPLAY IMAGES

FIELD OF THE INVENTION

The present invention relates generally to the compensation of display images, and particularly to a compensation circuit for display images and a method for determining compensation region of display images.

BACKGROUND OF THE INVENTION

Due to the excellent visual effects and user experience of full-screen displays, various mobile phone brands introduce their full-screen display products. The display of a traditional mobile phone screen is a 16:9 rectangle with right corner angles. To dispose the front camera, distance transducer, or microphone on the phone body, there is a certain gap between the screen and the top and bottom edges. Nonetheless, the screen of an 18:9 full-screen mobile phone is normally larger than 80% of the area of the display panel, making the screen edge extremely close to the body of the mobile phone. If the right-angle solution is adopted, there will be no space to place the modules and devices. In addition, once the screen is close to the phone body, when the phone falls, the screen will be exposed to more impact and leading to breakage. Thereby, to lower the possibility of screen breakage and reserve space for devices, free-form cutting becomes crucial to process the screen to non-right angles.

In addition, after the introduction of 18:9 screens, iPhone X started the prevalence of the free-form cutting technology for accommodating the face recognition system. The free-form technology relates to R-cut, U-cut (also called as Notch-cut), and C-cut for screens according to different requirements with the following two purposes. First, by applying C-cut or R-cut at the four corners of a screen, the possibility of screen breakage can be lowered. Secondly, by applying U-cut (Notch-cut) at the top of a screen, the space for the devices such as the front camera, distance transducer, and microphone can be reserved.

After free-form cutting a panel, the cut edge appears sawtooth shapes while displaying. Unfortunately, there is no technology to practically improve the sawtooth problem. If the cut points are recorded in the driver IC, the recorded locations can be compensated and thus improving the sawtooth in display images. Nonetheless, this method requires massive storage space for recording these cut points. For example, an R-cut might require hundreds of cut points for storage.

Accordingly, the present invention provides a compensation circuit for display images and a method for determining compensation region of display images. It requires no massive storage space for recording the cut points of a panel. In addition, the visual effect is excellent after compensation.

SUMMARY

An objective of the present invention is to provide a compensation circuit for display images and a method for determining compensation region of display images. It requires no massive storage space for recording the cut points of a panel. In addition, the visual effect is excellent after compensation.

The present invention discloses a compensation circuit for display images, which comprises a weighting circuit and a pixel compensation circuit. The weighting circuit calculates a first compensation boundary and a second compensation boundary corresponding to the location of a panel cut region. The region between the first and second compensation boundaries is an image compensation region. According to a display location of an input pixel and the image compensation region, a weighting factor is calculated. The pixel compensation circuit is coupled to the weighting circuit for receiving the weighting factor and the input pixel, and generates a display pixel by compensating the input pixel according to the weighting factor.

The present invention discloses a method for determining compensation region for display images, which comprises steps of: calculating a first compensation boundary corresponding to the location of a first panel cut region; and calculating a second compensation boundary corresponding to the location of the first panel cut region, the region between the first compensation boundary and the second compensation boundary is a first image compensation region.

DETAILED DESCRIPTION

In the specifications and subsequent claims, certain words are used for representing specific devices. A person having ordinary skill in the art should know that hardware manufacturers might use different nouns to call the same device. In the specifications and subsequent claims, the differences in names are not used for distinguishing devices. Instead, the differences in whole technique are the guidelines for distinguishing. In the whole specifications and subsequent claims, the word "comprising" is an open language and should be explained as "comprising but not limited to". Besides, the word "couple" includes any direct and indirect electrical connection. Thereby, if the description is that a first device is coupled to a second device, it means that the first device is connected electrically to the second device directly, or the first device is connected electrically to the second device via other device or connecting means indirectly.

In order to make the structure and characteristics as well as the effectiveness of the present invention to be further understood and recognized, the detailed description of the present invention is provided as follows along with embodiments and accompanying figures.

Figure 1:
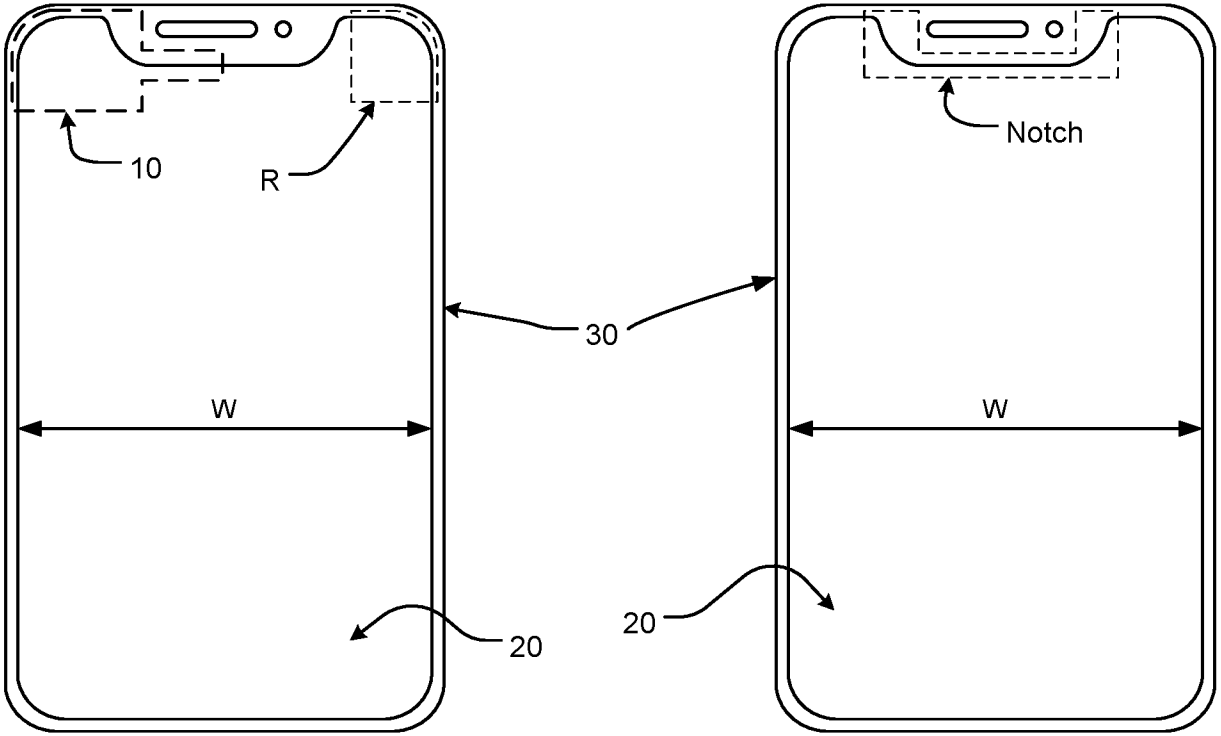
FIG. 1 shows a schematic diagram of the free-from display panel according to a first embodiment of the present invention.

Please refer to FIG. 1, which shows a schematic diagram of the free-from display panel according to a first embodiment of the present invention. As shown in the figure, the W in FIG. 1 is the width of a display panel; 20 is the display panel; 30 is the housing of the device, such as the body of a mobile phone. The cutting factory sets the size of the display panel 20 and cuts to give a free-form display panel. The display panel 20 includes multiple free-form cuts, namely, the panel cut regions 10, R, Notch, which includes the R-cut and the Notch-cut. In addition, the cutting factory holds the cutting parameters of the display panel 20, such as the length and the width. According to the present invention, the cutting parameters can describe the corner R and the notch Notch of the various panel cut regions 10, R, Notch. In other words, it requires no massive cut points for describing the corner R and the notch Notch for performing compensation for display images. For example, it requires hundreds of cut points to describe a corner R. Contrarily, by applying the method according to the present invention, it is not required for the storage circuit in the compensation circuit to store massive cut points. It only needs to store the related parameters for describing the corner R and the notch Notch. Consequently, the compensation circuit calculates the related parameters to give the (approximate) cut locations of the corner R and the notch Notch and determine an image compensation region. The range of the image compensation region can be determined by a plurality of compensation boundaries, for example, a first compensation boundary and a second compensation boundary. Besides, the compensation circuit can be disposed in a driving chip. Moreover, by adjusting the stored parameters, the image compensation region can be adjusted. Namely, if the error in the cutting parameters given by the cutting factory is too large, by adjusting the stored parameters and settings such as the pixel pitch, the image compensation region can be adjusted, and thus adjusting the image compensation effect. According to the present invention, the display images in the image compensation region is weakened for alleviating the visual effect of sawtooth shapes. Nonetheless, the present invention is not limited to weakening process for compensation.

Figure 2:
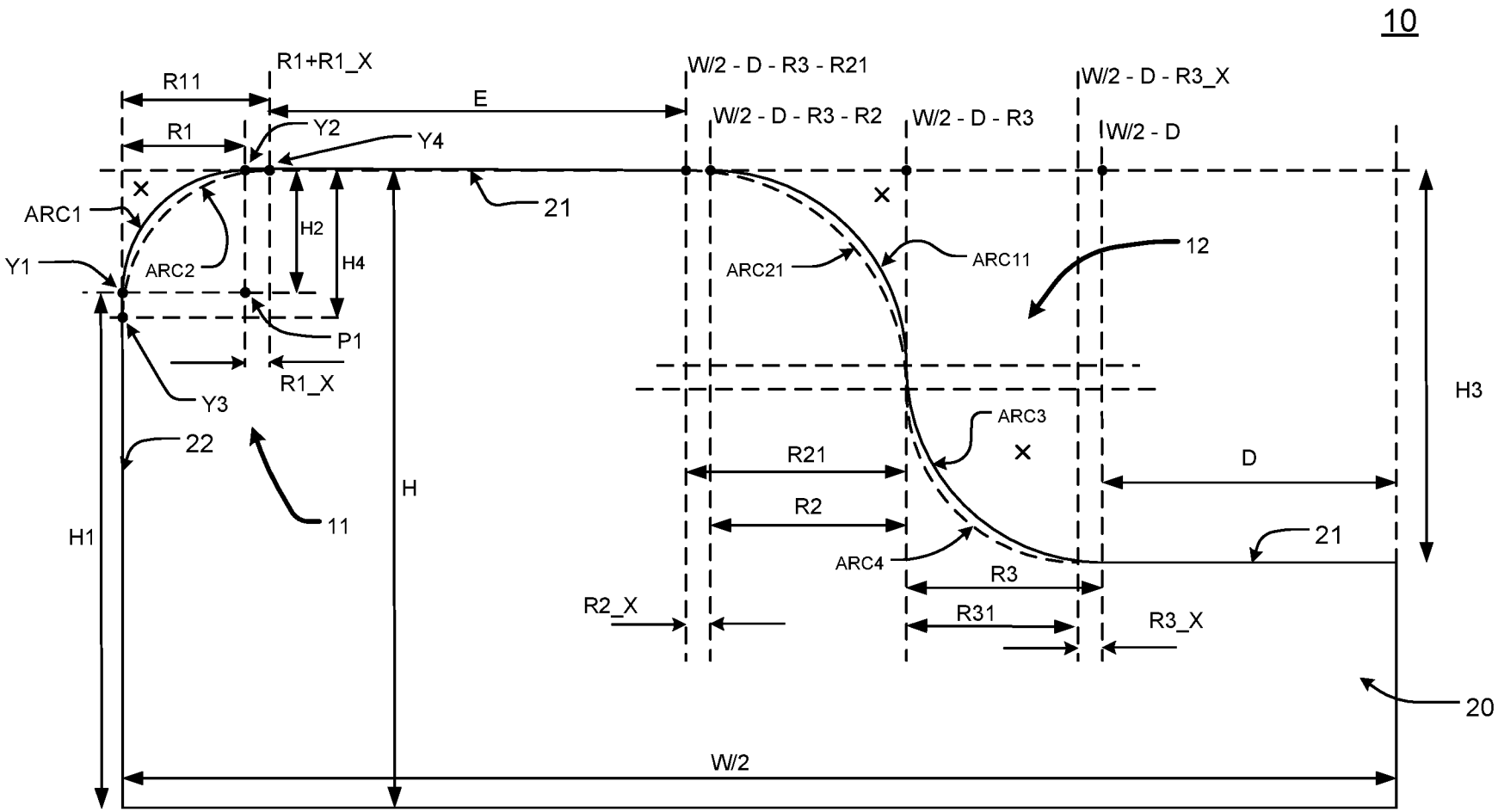
FIG. 2 shows the method for determining compensation region for free-form display panel according to a first embodiment of the present invention.

Please refer to FIG. 2, which shows the method for determining compensation region for free-form display panel according to a first embodiment of the present invention. As shown in the figure, FIG. 2 is the enlarged view of the panel cut region 10 encompassed by dashed lines at the top left corner of FIG. 1. The width of the display panel 20 shown in FIG. 1 is W. The width W depends on different display panels and is not limited. The illustrated width of the panel cut region 10 is a half of the width of the display panel 20 shown in FIG. 1, namely, W/2. In addition, the image compensation region of the top-left corner R of the first panel cut region 11 is determined, likewise, by the first compensation boundary and a second compensation boundary. According to FIG. 2, the first compensation boundary includes a first compensation arc ARC1; the second compensation boundary includes a second compensation arc ARC2.

The first compensation arc ARC1 of the first compensation boundary can be an arc of a circle. Thereby, the radius of the circuit can be used to calculate the first compensation arc ARC1. The radius of the circuit is a first compensation radius R1, which is a first arc parameter for calculating the first compensation boundary. The method to acquire the first compensation radius R1 is first to define an initial point Y1 and an end point Y2 of the first compensation arc ARC1 in the first panel cut region. The initial point Y1 and the end point Y2 correspond to the locations, for example, the cut locations, in the first panel cut region 11. Thereby, according to the initial point Y1 and the end point Y2 of the first compensation arc ARC1, the length of the first compensation radius R1 is given. Besides, by means of the initial point Y1, the end point Y2, and the first compensation radius R1, a central point P1 will be given. Hence, by measuring the panel cut region 10, the first compensation radius R1 is given. Alternatively, the length of the first compensation radius R1 can be preset. Furthermore, to describe the circuit, the hyperelliptic equation can be used:

$$\left|\frac{x-p}{a}\right|^m + \left|\frac{y-q}{b}\right|^n = 1;\ m, n > 0$$

and $$-a \le x - p \le +a$$

$$-b \le y - q \le +b$$

Once the parameters m and n in the hyperelliptic equation are set to 2 and the parameters a and b are both set to the first compensation radius R1, the equation becomes a circle equation. It can be used to describe the first compensation arc ARC1, where the parameters p and q are the center of the circle; x and y can be the initial point Y1 and the end point Y2. In other words, the first arc parameters to describe the first compensation arc ARC1 include the first compensation radius R1 and the centers p, q. By substituting the first arc parameters to the circle equation (namely, the set hyperelliptic equation) and calculating, the first compensation arc ARC1 corresponding to the first panel cut region 11 can be given (or described). The region X at the top left side of the first compensation arc ARC1 is outside the first panel cut region 11, making it a non-image display region. Contrarily, the bottom right side of the first compensation arc ARC1 is an image display region.

In addition, to simply the calculation procedure, the circle equation can be adopted directly for describing the first compensation arc ARC1, instead of setting a hyperelliptic equation to a circle equation before describing the first compensation arc ARC1. Thereby, the circle equation for describing the first compensation arc ARC1 is:

$$\left|\frac{x-p}{r}\right|^2 + \left|\frac{y-q}{r}\right|^2 = 1$$

and $$-r \le x - p \le +r$$

$$-r \le y - q \le +r$$

where r is the compensation radius; p and q are the centers of the circle.

In addition to defining the first arc parameters (including an initial point Y1 and an end point Y2) of the first compensation arc ARC1, they can be acquired according to other parameters of the panel cut region 10. For example, according to FIG. 2, subtracting the height H1 beyond the first compensation arc ARC1 from the height H of the panel cut region 10 will give the height H2. Then the height H2 (the radius of the circle) can be used as the first arc parameter for describing the first compensation arc ARC1. The height H and the height H1 are the related parameters to calculate the first arc parameter. Besides, if the cutting factory can provide the height H2 directly, the above calculation can be omitted and the height H2 can be preset as the first arc parameter. Likewise, according to the present invention, the width (W/2) of the panel cut region 10 can be used to give the first arc parameter for describing the first compensation arc ARC1. For example, according to a first side length 21, the parameter of the first compensation arc ARC1 can be given. Moreover, the first side length 21 and a second side length 22 in the embodiment of FIG. 2 are originally used to describe the top side length and the left side length of the panel cut region 10. According to the present embodiment, the top side length and the left side length of the panel cut region 10 can be renamed to the second side length 22 and the first side length 21. That is to say, the naming of the components in the description according to the present embodiment is used for explaining the technical content only, instead of limiting the embodiments of the present invention.

Accordingly, once the location of the first compensation arc ARC1 is given, the (cut) location of the curve at the top left corner of the first panel cut region 11 can be predicted. Thereby, the location of the first compensation arc ARC1 is related to the compensation effect of display images. If the location of the first compensation arc ARC1 deviates significantly and leading to inferior visual effect after compensation, by adjusting the stored parameters, for example, the length of the first compensation radius R1, the location (or curvature) of the first compensation arc ARC1 can be modified for approximating the real location (or curvature) of the curve at the top left corner of the first panel cut region 11 and hence improving the visual effect.

Furthermore, by using the locations of the first panel cut region 11, for example, a point Y3 and a point Y4, a second arc parameter, namely, the second compensation radius R11, of a second compensation arc ARC2 can be given. In other words, according to multiple locations related to the first panel cut region 11, the first compensation arc ARC1 of the first compensation boundary and the second compensation arc ARC2 of the second compensation boundary can be calculated. Thereby, the region encompassed by the first compensation arc ARC1 of the first compensation boundary and the second compensation arc ARC2 of the second compensation boundary is a first image compensation region. Namely, to make the first image compensation region larger (smaller), the difference between the radius of the second compensation radius R11 of the second compensation arc ARC2 and the radius of the first compensation radius R1 of the first compensation arc ARC1 can be set larger (smaller). According to the embodiment of FIG. 2, the difference between the radius of the second compensation radius R11 of the second compensation arc ARC2 and the radius of the first compensation radius R1 of the first compensation arc ARC1 is a radius difference R1_X. Thereby, the second compensation radius R11 of the second compensation arc ARC2 is the first compensation radius R1 plus the radius difference R1_X. By setting a=b=R11 and m=n=2 in the hyperelliptic equation, the second compensation arc ARC2 can be described as well. In other words, according to the second compensation radius R11 and the hyperelliptic equation, the second compensation arc ARC2 can be calculated. Consequently, according to the compensation method according to the present invention, the related parameters of the panel cut region 10 and the hyperelliptic equation are used to describe the corner R and hence determining the image compensation region for performing image compensation. Besides, only the related parameters of the panel cut region 10 are stored, and thus avoiding usage of massive storage space for storing the cut points for describing the corner R.

Alternatively, according to the embodiment in FIG. 2, the second compensation arc ARC2 can be calculated first according to the related parameters of the first panel cut region 11 before the first compensation arc ARC1 is calculated. The present invention is not limited to the order of calculating the first compensation arc ARC1 and the second compensation arc ARC2.

Please refer again to FIG. 2. The right second panel cut region 12 in the embodiment can be divided into top and down cut regions. The top cut region also includes an R-cut. Thereby, the compensation radius R2 and the compensation radius R21 in the right are equivalent to the first compensation radius R1 and the second compensation radius R11 in the R-cut in the left first panel cut region 11; the compensation arc ARC11 and the compensation arc ARC21 in the right are equivalent to the first compensation arc ARC1 and the second compensation arc ARC2. Hence, the compensation radius R2 and the compensation radius R21 are both used to as parameters for describing the corner R in the top cut region of the second panel cut region 12 in the right. In other words, by substituting the compensation radius R2 and the compensation radius R21 into the hyperelliptic equation, the image compensation region of the corner R in the right can be predicted as well. The compensation radius R2 and the compensation radius R21 can be derived by measurement. Likewise, the centers of the compensation radius R2 and the compensation radius R21 can be deduced as well. The two compensation arcs ARC11, ARC21 also encompass another image compensation region. The rest technology is the same as the above description and will not be described again. Alternatively, the compensation radius R2 and the compensation radius R21 can be preset values.

Moreover, the second panel cut region 12 in the right half of FIG. 2 is a Notch-cut. The image compensation region at the bottom of the second panel cut region 12 can be determined by the third compensation arc ARC3 and the fourth compensation arc ARC4, which can be deduced according to the above description. Thereby, the Notch-cut is equivalent to the top cur region (the first cut region) and the bottom cut region (the second cut region), and hence includes four compensation boundaries, including the compensation arc ARC11 (namely, the first compensation arc of the notch Notch), the compensation arc ARC21 (namely, the second compensation arc of the notch Notch), the third compensation arc ARC3, and the fourth compensation arc ARC4. In the notch Notch, in addition to the region encompassed by the third compensation arc ARC3 and the fourth compensation arc ARC4, there is a second image compensation region of the notch Notch encompassed by the third compensation arc ARC3, and the fourth compensation arc ARC4. In addition, as shown in FIG. 2, the four compensation arcs ARC11, ARC21, ARC3, ARC4 are interconnected by an end point, respectively. Besides, the third compensation arc ARC3 is connected to the first compensation arc ARC11 of the notch Notch to be a first continuous arc; the fourth compensation arc ARC4 is connected to the second compensation arc ARC21 of the notch Notch to be a second continuous arc. The first continuous arc and the second continuous arc define two image compensation regions.

The fourth compensation arc ARC4 and the third compensation arc ARC3 have a radius difference R3_X. Thereby, likewise, according to the parameters related to the second panel cut region 12, the third compensation arc ARC3 and the fourth compensation arc ARC4 of the notch Notch can be calculated. The region between the third compensation arc ARC3 and the fourth compensation arc ARC4 is the image compensation region.

In addition, the initial point of the compensation arc ARC11 is W/2-D-R3 while the end point thereof is W/2-D-R3-R2. The initial point of the compensation arc ARC21 is W/2-D-R3 while the end point thereof is W/2-D-R3-R21. Thereby, the radius difference between the compensation arc ARC21 and the compensation arc ARC11 is R2_X. Besides, likewise, for the four arcs ARC11, ARC3, ARC21, ARC4 of the notch Notch, the compensation radii can be calculated according to a height H3 of the panel cut region 10 in FIG. 2. For example, after the height H3 is known, the total length of the compensation radius R21 and the third compensation radius R3 is determined to be H3. Thereby, if the radius R21 is shortened, the third compensation radius R3 will be lengthened; if the radius R21 is lengthened, the third compensation radius R3 will be shortened. Hence, according to the height of the panel cut region 10, the locations of the four arcs ARC11, ARC3, ARC21, ARC4 of the notch Notch can be calculated as well.

Accordingly, the third compensation radius R3 of the third compensation arc ARC3 is used to calculate the third compensation arc ARC3. The third compensation radius R3 is a third arc parameter. The fourth compensation radius R31 of the fourth compensation arc ARC4 is used to calculate the fourth compensation arc ARC4. The fourth compensation radius R31 is a fourth arc parameter. In other words, according to the third arc parameter and the hyperelliptic equation, the third compensation boundary can be calculated; according to the fourth arc parameter and the hyperelliptic equation, the fourth compensation boundary can be calculated.

Figure 3:
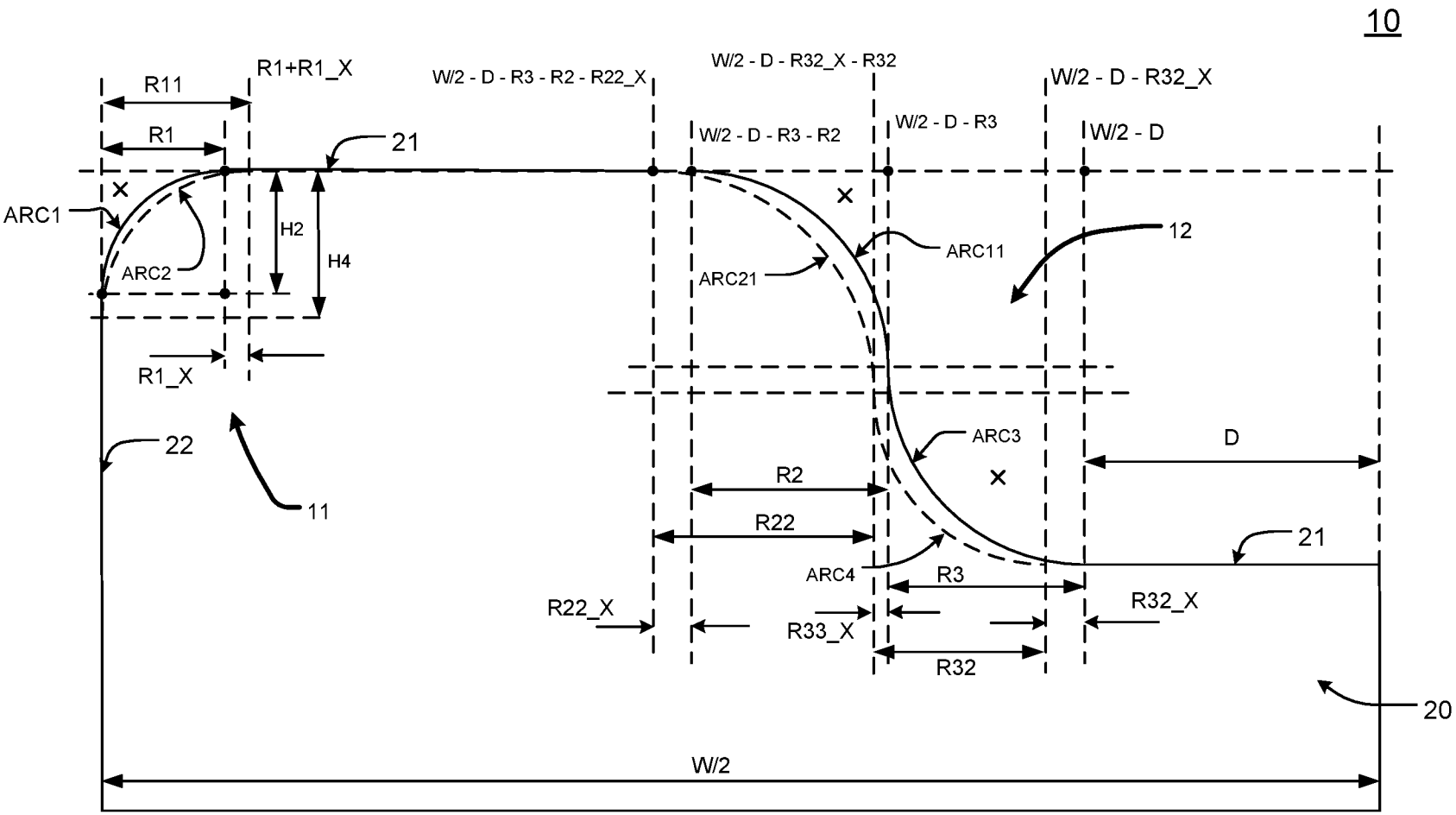
FIG. 3 shows the method for determining compensation region for free-form display panel according to a second embodiment of the present invention.

Please refer to FIG. 3, which shows the method for determining compensation region for free-form display panel according to a second embodiment of the present invention. The compensation arc ARC21 and the fourth compensation arc ARC4 of the notch Notch are shifted to the left by a shift location R33_X and producing a pixel gap with respect to the compensation arc ARC11 and the third compensation arc ARC3. The pixel gap can be one or more pixel length. Preferably, the pixel gap is 1 to 3 pixel lengths. In addition, a pixel occupies a pixel length, which is used to describe the gap between arcs. This gap is named as the pixel gap. Thereby, likewise, the first continuous arc and the second continuous arc can be spaced by one or more pixel length. Like the previous description, the second compensation arc ARC2 of the first panel cut region 11 can be shifted to produce one or more pixel length between the second compensation arc ARC2 and the first compensation arc ARC1. In FIG. 3, the real pixel length is not plotted; it is used for illustration only. By comparing the two compensation arcs ARC1, ARC2 at the top left corner of FIG. 3 with the four compensation arcs ARC11, ARC3, ARC21, ARC4 of the notch Notch, whether the difference caused shift can be observed. After shifting, the range of the image compensation region changes, and hence changing the visual effect after compensation. In other words, the choice of the design of a radius difference R1_X between the first compensation arc ARC1 and the second compensation arc ARC2 and the design of a radius difference R1_X and a pixel gap between the first compensation arc ARC1 and the second compensation arc ARC2 is determined according to the visual effect after compensation.

Accordingly, the initial point of the compensation arc ARC21 is W/2-D-R32_X-R32 and the end point thereof is W/2-D-R3-R2-R22_X; the initial point of the fourth compensation arc ARC4 is changed to W/2-D-R32_X and the end point thereof is W/2-D-R32_X-R32. Hence, the compensation radius of the compensation arc ARC21 is R22; the radius of the fourth compensation arc is ARC4. Besides, the joint of the compensation arc ARC21 and the fourth compensation arc ARC4 is not connected with the joint of the compensation arc ARC11 and the third compensation arc ARC3. The rest is the same as the above description and hence will not be repeated.

Figure 4:
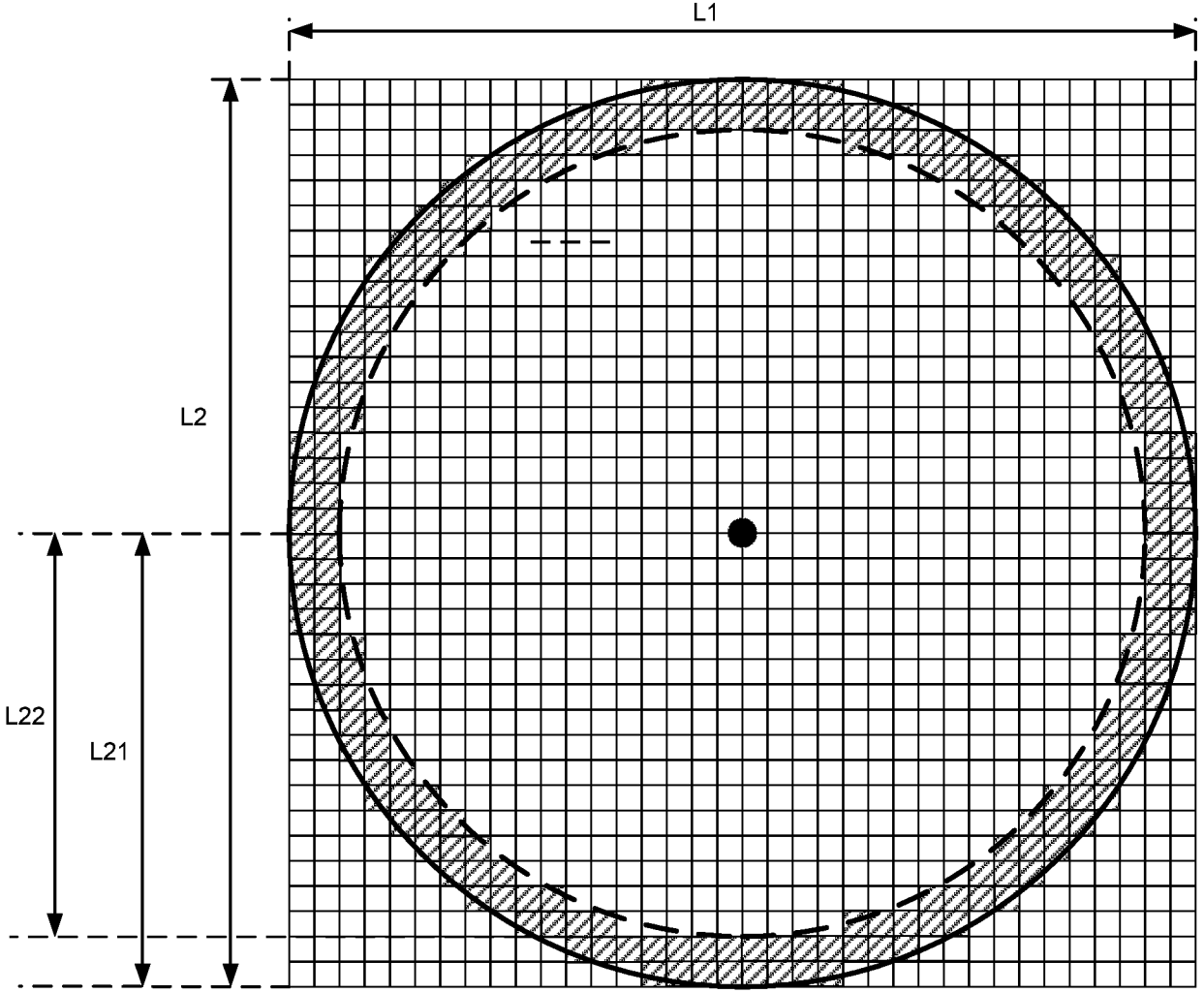
FIG. 4 shows the method for determining compensation region for free-form display panel according to a third embodiment of the present invention.

Please refer to FIG. 4, which shows the method for determining compensation region for free-form display panel according to a third embodiment of the present invention. As shown in the figure, a circular display panel, for example, a watch, is illustrated. In addition to mobile phones, the compensation method according to the present invention can be applied to compensation of display images for watches. The size of the circular display panel can be represented by lengths L1, L2, which can be the side length of a rectangle or the diameter of a circle. Thereby, after acquiring the lengths L1, L2, the first arc parameter, namely, the compensation radius L21, of the outer circle can be deduced. By using the compensation radius L21 and the hyperelliptic equation or the circle equation, the first compensation boundary of the outer circle can be calculated. Likewise, after setting the radius difference (L21-L22), the second arc parameter, namely, the compensation radius L22, of the inner circle can be deduced according to the radius difference and the compensation radius L21 of the outer circle. Besides, by using the compensation radius L22 and the hyperelliptic equation or the circle equation, the second compensation boundary of the inner circle can be calculated.

Accordingly, the first compensation boundary and the second compensation boundary form two concentric circles. The region between the two compensation boundaries is the image compensation region. As shown in the embodiment of FIG. 4, the image compensation region is represented by the shaded area. According to the shaded area, it is observed that after image weakening, the sawtooth shape is smoothened, making the display image more approximate to a circle and meet the visual requirement of a circular watch.

Figure 5:
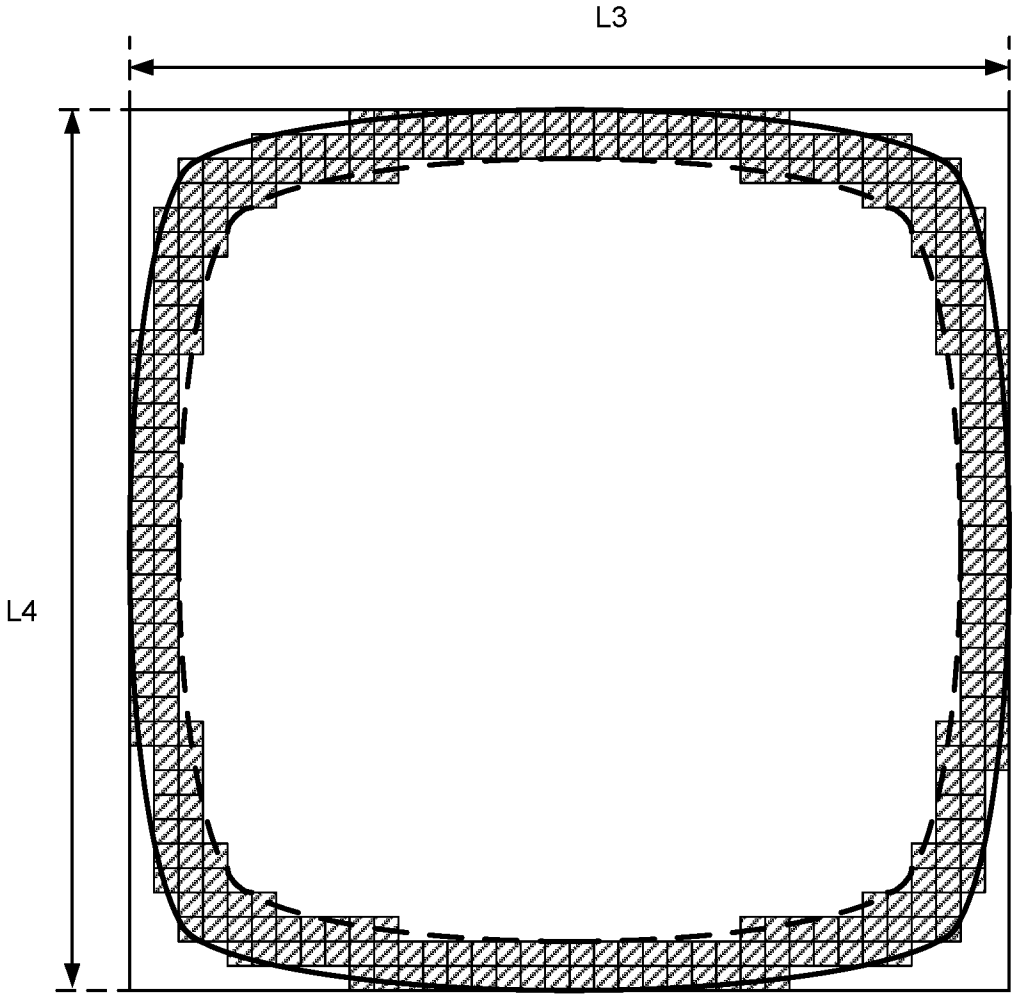
FIG. 5 shows the method for determining compensation region for free-form display panel according to a fourth embodiment of the present invention.

Please refer to FIG. 5, which shows the method for determining compensation region for free-form display panel according to a fourth embodiment of the present invention. As shown in the figure, an approximate elliptic display panel is illustrated. The display panel is cut from a square display panel. In addition, according to the figure of the embodiment, it is observed that the image compensation regions at the four sides approximate to ellipses. In other words, the compensation arcs are elliptic arcs. By referring the design parameters of an elliptic display panel, the lengths of a first major axis and a first minor axis of the outer ellipse and the lengths of a second major axis and a second minor axis of the inner ellipse can be set. Then, according to the lengths of the first and second major axes and the first and second minor axes as well as the hyperelliptic equation, the elliptic arcs (the compensation arcs) of the inner and outer ellipses can be calculated. Alternatively, after setting the pixel gap, the lengths of the first major axis and the first minor axis of the outer ellipse are reduced according to the pixel gap to give the second major axis and the second minor axis, which are further used to deduce the elliptic arcs of the inner ellipse. The lengths of the second major and minor axes are smaller than the lengths of the first major and minor axes.

In other words, the elliptic arcs (the compensation arcs) of the inner ellipse can be deduced according to the pixel gap and the elliptic arcs (the compensation arcs) of the outer ellipse. The four compensation arcs of the outer ellipse are connected to form the compensation boundary of the outer ellipse; the four compensation arcs of the inner ellipse are connected to form the compensation boundary of the inner ellipse. Likewise, the compensation boundary of the outer ellipse and the compensation boundary of the inner ellipse can be spaced by one or more pixel length. Moreover, the joint of the elliptic arcs might appear discontinuous, leading to inferior shift visual effect of the image compensation region. Accordingly, by adjusting the parameters (the values of the major and minor axes), the compensation boundaries of the inner and outer ellipses can be more continuous and smoother. Besides, under the consideration of costs, the hyperelliptic equation according to the embodiment in Figure can be replaced by an elliptic equation, which is expressed by:

$$\left|\frac{x-p}{a}\right|^2+\left|\frac{y-q}{b}\right|^2=1;\ m,n>0$$

where a and b are the major and minor axes of the ellipse, and $$-a\leq x-p\leq +a$$

$$-b\leq y-q\leq +b$$

Thereby, all compensation arcs in the embodiment of FIG. 5 can be calculated by a hyperelliptic equation. Alternatively, after calculating each compensation arc using an elliptic equation, it is tested whether gaps exist by jointing the compensation arcs.

Figure 6:
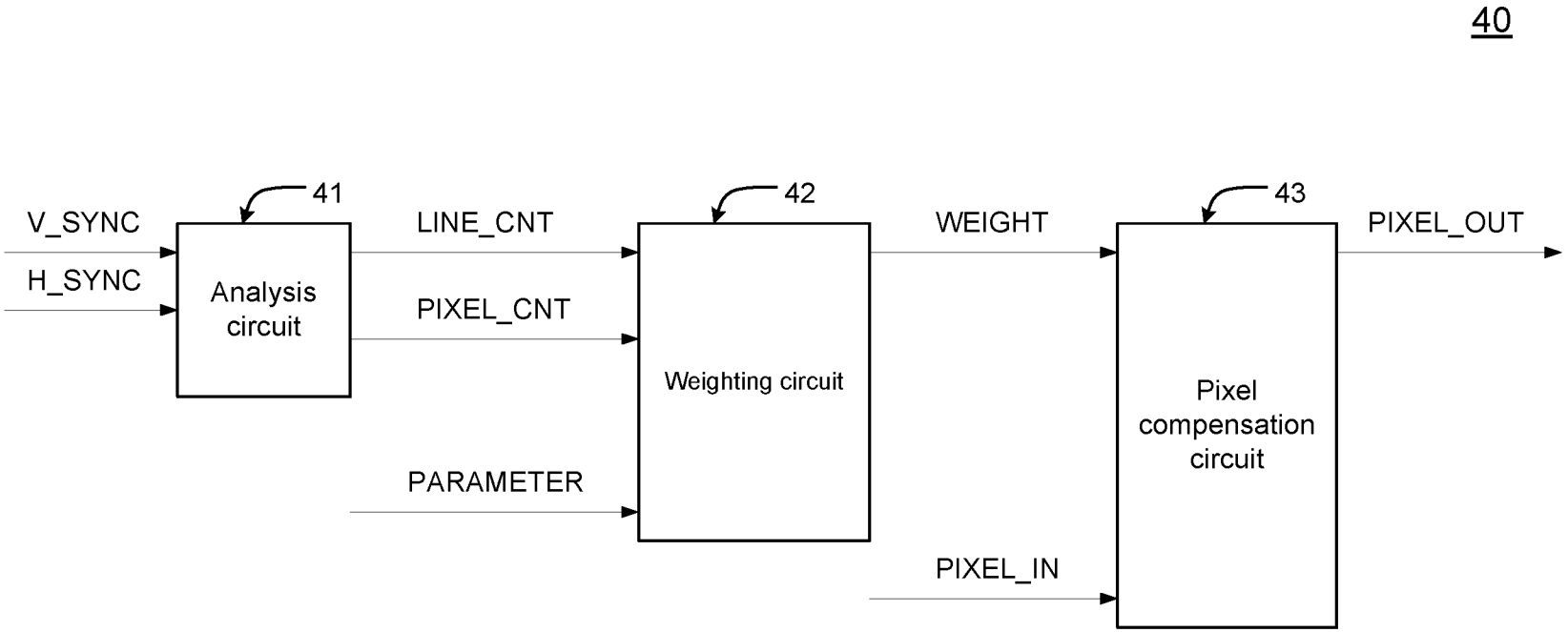
FIG. 6 shows a schematic diagram of the compensation circuit for display images according to an embodiment of the present invention.

Please refer to FIG. 6, which shows a schematic diagram of the compensation circuit for display images according to an embodiment of the present invention. As shown in the figure, the compensation circuit 40 comprises a weighting circuit 42 and a pixel compensation circuit 43. The weighting circuit 42 receives one or more arc parameter PARAMETER, which is the parameter for cutting panels, such as the side length 21, 22, the first compensation radius R1, the second compensation radius R11, the width W/2, or the height H. Thereby, the weighting circuit 42 corresponds to the location of the panel cut region and determines the image compensation region. According to the previous embodiments, it is known that the image compensation region is determined by a plurality of compensation boundaries. That is to say, the weighting circuit 42 calculates the first compensation boundary and the second compensation boundary according to the arc parameter PARAMETER. The region between the first compensation boundary and the second compensation boundary is the image compensation region.

Furthermore, the compensation circuit 40 comprises an analysis circuit 41, which receives and analyzes a vertical synchronization signal V_SYNC and a horizontal synchronization signal H_SYNC corresponding to an input pixel PIXEL_IN to generate a pixel vertical location signal LINE_CNT and a pixel horizontal location signal PIXEL_CNT to the weighting circuit 42. Thereby, the analysis circuit 41 is coupled to the weighting circuit 42 for outputting a display location information to the weighting circuit 42. The pixel vertical location signal LINE_CNT and the pixel horizontal location signal PIXEL_CNT described above are used to represent a display location of the input pixel PIXEL_IN. The display location includes a vertical location and a horizontal location. Thereby, the weighting circuit 42 receives the display location information (the pixel vertical location signal LINE_CNT and the pixel horizontal location signal PIXEL_CNT), and judges if the pixel location is within the image compensation region according to the display location information and the image compensation region. If the pixel is within the image compensation region, the weighting circuit 42 calculates the weighting factor WEIGHT corresponding to the input pixel PIXEL_IN and transmits the weighting factor WEIGHT to the pixel compensation circuit 43. In other words, the weighting circuit 42 generates the weighting factor WEIGHT of the input pixel PIXEL_IN to the pixel compensation circuit 43 according to the display location of the input pixel PIXEL_IN and the image compensation region.

The pixel compensation circuit 43 is coupled to the weighting circuit 42 and receives the weighting factor WEIGHT and the input pixel PIXEL_IN for generating a display pixel PIXEL_OUT by compensating (adjusting) the input pixel PIXEL_IN according to the weighting factor WEIGHT. Namely, the pixel compensation circuit 43 generates the display pixel PIXEL_OUT according to the weighting factor WEIGHT and the input pixel PIXEL_IN. The display pixel PIXEL_OUT can output to a source driving circuit, which outputs a source signal to the display panel 20 according to the display pixel PIXEL_OUT. The weighting circuit 42 can include a storage circuit (or called a storage unit, such as a register and a memory, etc.) for storing the arc parameter PARAMETER. The compensation circuit 40 compensates (adjusts) the input pixel PIXEL_IN according to the stored arc parameter PARAMETER for generating the display pixel PIXEL_OUT. The adjustment of the input pixel PIXEL_IN refers to the weakening in the visual effect. Contrarily, if the enhancement of the visual effect can improve the compensation effect of display images, different adjustment methods can be adopted as well. The present invention does not limit the methods. In addition, the storage circuit described above can be disposed individually outside the weighting circuit 42.

The present invention does not limit the method by which the pixel compensation circuit 43 compensates (adjusts) the input pixel PIXEL_IN. The compensation method can include, for example, the linear interpolation method, the bilinear interpolation method, the cubic interpolation method, and the bicubic interpolation method.

To sum up, the present invention discloses a compensation circuit for display images, which comprises a weighting circuit and a compensation circuit. The weighting circuit calculates a first compensation boundary and a second compensation boundary corresponding to the location of a panel cut region. The region between the first and second compensation boundaries is an image compensation region. According to a display location of an input pixel and the image compensation region, a weighting factor is calculated. The pixel compensation circuit is coupled to the weighting circuit for receiving the weighting factor and the input pixel, and generates a display pixel by compensating the input pixel according to the weighting factor.

The present invention discloses a method for determining compensation region for display images, which comprises steps of: calculating a first compensation boundary corresponding to the location of a first panel cut region; and calculating a second compensation boundary corresponding to the location of the first panel cut region, the region between the first compensation boundary and the second compensation boundary is a first image compensation region.

The invention claimed is:

1. A method for determining compensation region for display images, comprising steps of:

calculating a first compensation boundary corresponding to the location of a first panel cut region;

calculating a second compensation boundary corresponding to the location of said first panel cut region, wherein the region between said first compensation boundary and said second compensation boundary is a first image compensation region;

producing a weighting factor according to a display location of an input pixel and said image compensation region;

receiving said weighting factor and said input pixel; and compensating said input pixel according to said weighting factor for producing a display pixel.

2. The method for determining of claim 1, and further comprising steps of:

calculating said first compensation boundary according to one or more first arc parameter, and said first compensation boundary including a first compensation arc; and calculating said second compensation boundary according to one or more second arc parameter, and said second compensation boundary including a second compensation arc.

3. The method for determining of claim 2, wherein said one or more first arc parameter includes a first compensation radius; said one or more second arc parameter includes a second compensation radius; and said method further comprises steps of:

calculating said first compensation arc according to said first compensation radius; and calculating said second compensation arc according to said second compensation radius.

4. The method for determining of claim 3, and further comprising steps of:

calculating said first compensation arc according to said first compensation radius and a hyperelliptic equation or a circle equation; and calculating said second compensation arc according to said second compensation radius and said hyperelliptic equation or said circle equation.

5. The method for determining of claim 3, wherein the difference between said first compensation radius and said second compensation radius is a radius difference.

6. The method for determining of claim 3, and further comprising a step of shifting said second compensation arc.

7. The method for determining of claim 2, wherein said first compensation arc is a first elliptic arc; said second compensation arc is a second elliptic arc; said one or more first arc parameter includes a first major axis and a first minor axis; said one or more second arc includes a second major axis and a second minor axis; and said method further comprises steps of:

calculating said first compensation arc according to said first major axis, said first minor axis, and an elliptic equation or a hyperelliptic equation; and calculating said second compensation arc according to said second major axis, said second minor axis, and second elliptic equation or second hyperelliptic equation.

8. The method for determining of claim 2, wherein said first compensation boundary and said second compensation boundary are circular and concentric; said one or more first arc parameter includes a first compensation radius; said one or more second arc parameter includes a second compensation radius; and said method further comprises steps of:

calculating said first compensation boundary according to said first compensation radius; and calculating said second compensation boundary according to said second compensation radius.

9. The method for determining of claim 1, and further comprising steps of:

calculating a third compensation boundary corresponding to the location of a second panel cut region; and calculating a fourth compensation boundary corresponding to the location of said second panel cut region;

where the region between said third compensation boundary and said fourth compensation boundary is a second image compensation region.

10. The method for determining of claim 9, and further comprising steps of:

calculating said third compensation boundary according to one or more third arc parameter, and said third compensation boundary including a third compensation arc; and calculating said fourth compensation boundary according to one or more fourth arc parameter, and said fourth compensation boundary including a fourth compensation arc.

11. The method for determining of claim 10, wherein said one or more third arc parameter includes a third compensation radius; said one or more fourth arc parameter includes a fourth compensation radius; and said method further comprises steps of:

calculating said third compensation arc according to said third compensation radius; and calculating said fourth compensation arc according to said fourth compensation radius;

where the difference between said third compensation radius and said fourth compensation radius is a radius difference.

12. The method for determining of claim 11, and further comprising steps of:

calculating said third compensation arc according to said third compensation radius and a hyperelliptic equation or a circle equation; and calculating said fourth compensation arc according to said fourth compensation radius and said hyperelliptic equation or said circle equation.

13. The method for determining of claim 10, and further comprising a step of shifting said fourth compensation arc.

14. The method for determining of claim 10, wherein said third compensation arc is connected to said first compensation arc and becomes a first continuous arc; and said fourth compensation arc is connected to said second compensation arc and becomes a second continuous arc.

15. A compensation circuit for display images, comprising:

a weighting circuit, calculating a first compensation boundary and a second compensation boundary corresponding to a location of a panel cut region, the region between said first compensation boundary and said second compensation boundary is an image compensation region, and producing a weighting factor according to a display location of an input pixel and said image compensation region; and a pixel compensation circuit, coupled to said weighting circuit, receiving said weighting factor and said input pixel, and compensating said input pixel according to said weighting factor for producing a display pixel.

16. The compensation circuit for display images of claim 15, wherein said weighting circuit receives a pixel vertical location signal and a pixel horizontal location signal, and produces said weighting factor according to said pixel vertical location signal, said pixel horizontal location signal, and said image compensation region.

17. The compensation circuit for display images of claim 16, and further comprising an analysis circuit, receiving a vertical synchronization signal and a horizontal synchronization signal, analyzing said vertical synchronization signal and said horizontal synchronization signal for generating said pixel vertical location signal and said pixel horizontal location signal, coupled to said weighting circuit, and outputting said pixel vertical location signal and said pixel horizontal location signal to said weighting circuit.

* * * * *